US011058265B2

(12) United States Patent
Kwak

(10) Patent No.: US 11,058,265 B2
(45) Date of Patent: Jul. 13, 2021

(54) PORTABLE TOILET

(71) Applicant: Jeoung Eun Kwak, Seoul (KR)

(72) Inventor: Jeoung Eun Kwak, Seoul (KR)

(73) Assignee: Jeoung Eun Kwak, Seoul (KR)

( * ) Notice: Subject to any disclaimer, the term of this patent is extended or adjusted under 35 U.S.C. 154(b) by 0 days.

(21) Appl. No.: 16/482,923

(22) PCT Filed: Oct. 16, 2018

(86) PCT No.: PCT/KR2018/012148
§ 371 (c)(1),
(2) Date: Aug. 1, 2019

(87) PCT Pub. No.: WO2019/078569
PCT Pub. Date: Apr. 25, 2019

(65) Prior Publication Data

US 2019/0357737 A1 Nov. 28, 2019

(30) Foreign Application Priority Data

Oct. 18, 2017 (KR) ..... 20-2017-0005390

(51) Int. Cl.
*A47K 11/04* (2006.01)
*A47K 13/06* (2006.01)

(52) U.S. Cl.
CPC ..... *A47K 11/04* (2013.01); *A47K 13/06* (2013.01)

(58) Field of Classification Search
CPC ..... A47K 11/04
USPC ..... 4/483, 479
See application file for complete search history.

(56) References Cited

FOREIGN PATENT DOCUMENTS

| | | |
|---|---|---|
| JP | 2015123370 | 7/2015 |
| KR | 20130120306 | 11/2013 |
| KR | 101650536 | 8/2016 |

*Primary Examiner* — Lori L Baker
(74) *Attorney, Agent, or Firm* — Lucas & Mercanti, LLP

(57) ABSTRACT

A portable toilet comprises a container-shaped body of which the top surface is opened and the inside is empty. A first toilet cover is provided on the opened top surface and formed in an arch shape, and a second toilet cover is disposed on the opened top surface so as to be symmetrical to the first toilet cover, wherein each of the first toilet cover and the second toilet cover rotates with respect to the body such that each one end portion of the first toilet cover and the second toilet cover can be spaced apart with respect to the body.

6 Claims, 9 Drawing Sheets

PORTABLE TOILET

BACKGROUND

Presented is a portable toilet. More particularly, presented is a bag-fastening type portable toilet to which a bag may be fastened by lifting a cover of a toilet from both sides, and which may be reduced in volume by rotatably folding for ease of moving and may be formed by unfolding.

RELATED ART

In general, children often have difficulty using a toilet outdoors due to the risk of infection or spatial constraints. For example, when using a public restroom in flooded areas such as a park, children with weakened immune systems may be infected with bacteria from toilets or water.

Alternatively, if many people are waiting in a public restroom, if the restroom is old-fashioned, if it is difficult to reach a restroom while travelling due to traffic, or if there is urgency but there is no restroom nearby, the child may experience constraint with respect to defecation.

In general, when a child performs defecation in a public restroom, a parent may need to place the child on a toilet to prevent infection and may also need to help the child defecate using a portable toilet cover or a provided toilet cover.

If it is difficult to access a restroom for a spatial reason, the child may be able to urinate in another area or may be able to defecate into a bag placed around hips of the child. Even in this situation, clean defecation is difficult and defecation may cause skin irritation.

A bag, a portable toilet cover, and the like, are being developed to be used in such situations. Also, portable toilets are being used and such a portable toilet is disclosed in Korean Patent Laid-Open Publication No. 10-2013-0120306.

SUMMARY OF THE INVENTION

An example embodiment provides a bag-fastening type portable toilet that may help a child perform clean defecation.

Another example embodiment provides a portable toilet that may be quickly installed to facilitate timely defecation when a child is performing an outdoor activity.

Another example embodiment provides a portable toilet that may be reduced in volume or formed through performing a simple rotation.

Another example embodiment provides a portable toilet that helps a child perform defecation from a stable posture.

Another example embodiment provides a bag-fastening type portable toilet to which a bag may be fastened and installed to simply handle waste discharged from a child by defecation.

Another example embodiment also provides a portable toilet that is easily insertable into a handbag.

A portable toilet according to an example embodiment may include a body in a shape of a container of which a top surface is open and an inside is empty; a first toilet cover provided on the open top surface and formed in an arch shape; and a second toilet cover provided on the open top surface to be symmetrical to the first toilet cover. Each of the first toilet cover and the second toilet cover may rotate with respect to the body such that each one end of the first toilet cover and the second toilet cover is spaced apart with respect to the body.

Also, ends of the first toilet cover and ends of the second toilet cover may be hinge-connected to the body at two sides of the top surface of the body to rotate in an upward direction or a horizontal direction in a state in which the ends of the first toilet cover and the ends of the second toilet cover are provided to face each other.

Also, when ends of the first toilet cover and the second toilet cover rotate in an upward direction, a defecation bag may be installed along the circumference of the open top surface of the body and inside the body.

Also, the body may include a first body member and a second body member, the first body member may be formed in the arch shape and the second body member may be formed in the arch shape such that the body is in the shape of the container of which the inside is empty, a diameter of the arch shape of the second body member may be formed to be less than that of the first body member, the first body member and the second body member may be provided such that the respective ends of the arch shapes overlap, the end of the first body member and the end of the second body member may be formed to be rotatable with respect to each other, and the first body member and the second body member may rotate such that the second body member folds within the arch shape of the first body member to be overlappingly folded in a single arch shape.

Also, the first toilet cover may be hinge-connected to the first body member and the second toilet cover may be hinge-connected to the second body member, such that the first toilet cover and the second toilet cover are respectively provided on both sides of the folded arch shape that is formed in response to rotation of the first body member and the second body member.

Also, the rotation of the first body member and the second body member may be suspended in response to a contact between a lower edge of the first body member and a bottom surface of the second toilet cover or a contact between a lower edge of the second body member and the bottom surface of the second toilet cover.

Also, the body may include one of a locking element and a hook element, the first toilet cover and the second toilet cover may include another one of a locking element and a hook element corresponding to the locking element or the hook element of the body, and the respective corresponding locking element and hook element may couple with each other such that the first toilet cover and the second toilet cover fasten to the body.

According to example embodiments, there may be provided a bag-fastening type portable toilet that may help a child perform clean defecation.

Also, according to example embodiments, there may be provided a portable toilet that may be quickly installed to facilitate timely defecation when a child is performing an outdoor activity.

Also, according to example embodiments, there may be provided a portable toilet that may be reduced in volume or formed through performing a simple rotation.

Also, according to example embodiments, there may be provided a portable toilet that helps a child perform defecation from a stable posture.

Also, according to example embodiments, there may be provided a bag-fastening type portable toilet to which a bag may be fastened and installed to simply handle waste discharged from a child by defecation.

Also, according to example embodiments, there may be provided a portable toilet that is easily insertable into a handbag.

DETAILED DESCRIPTION OF THE INVENTION

Figure 1A:
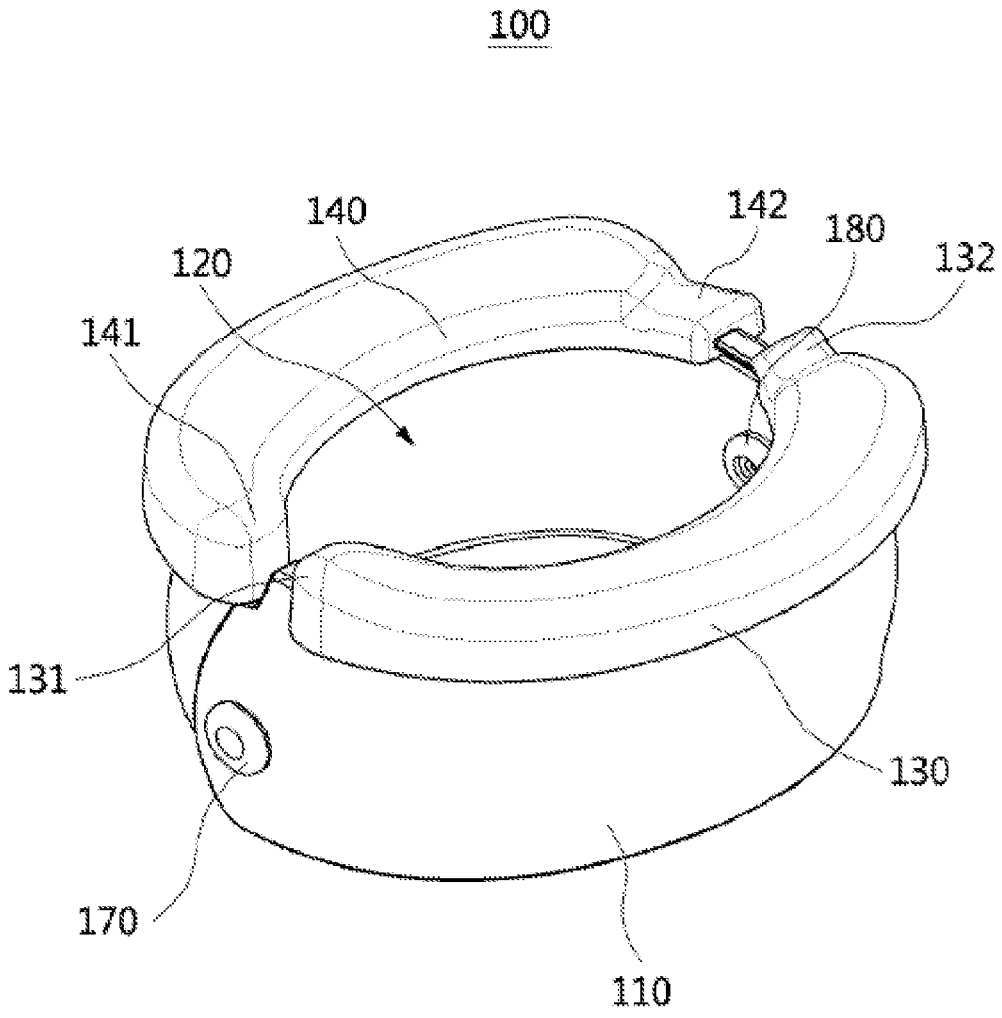
FIGS. 1*a*, 1*b*, 1*c*, and 1*d* are perspective views of a portable toilet according to an example embodiment.

Hereinafter, some example embodiments will be described in detail with reference to the accompanying drawings. Regarding the reference numerals assigned to the elements in the drawings, it should be noted that the same elements will be designated by the same reference numerals, wherever possible, even though they are shown in different drawings. Also, in the description of example embodiments, detailed description of well-known related structures or functions will be omitted when it is deemed that such description will cause ambiguous interpretation of the present disclosure.

In addition, terms such as first, second, A, B, (a), (b), and the like may be used herein to describe components. Each of these terminologies is not used to define an essence, order or sequence of a corresponding component but used merely to distinguish the corresponding component from other component(s). It should be noted that if it is described in the specification that one component is "connected", "coupled", or "joined" to another component, a still another component may be "connected", "coupled", and "joined" between the one component and the other component, although the one component may be directly connected, coupled or joined to the other component.

FIGS. 1*a*, 1*b*, 1*c*, and 1*d* are perspective views of a portable toilet according to an example embodiment.

Figure 1B:
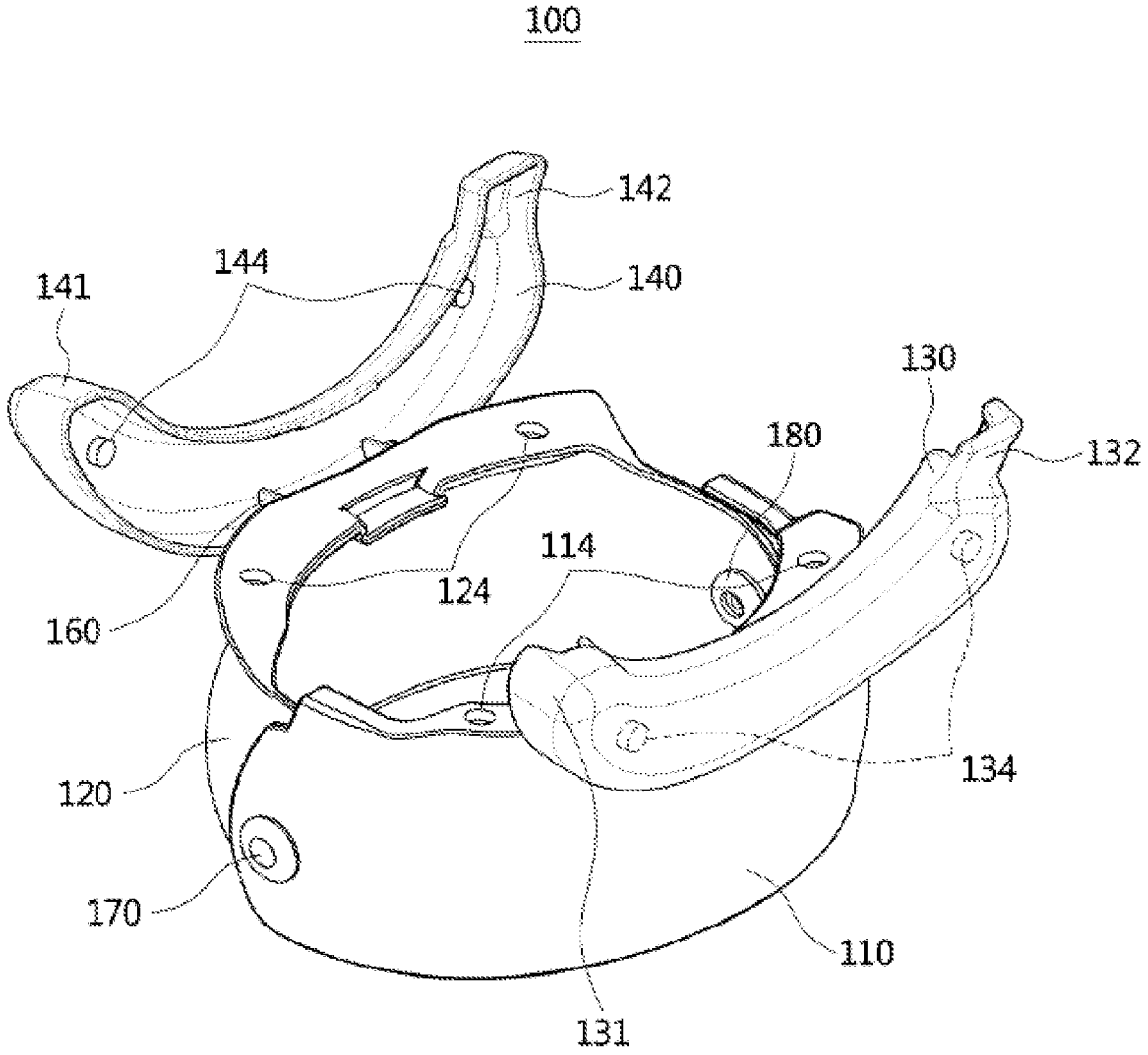
Figure 1C:
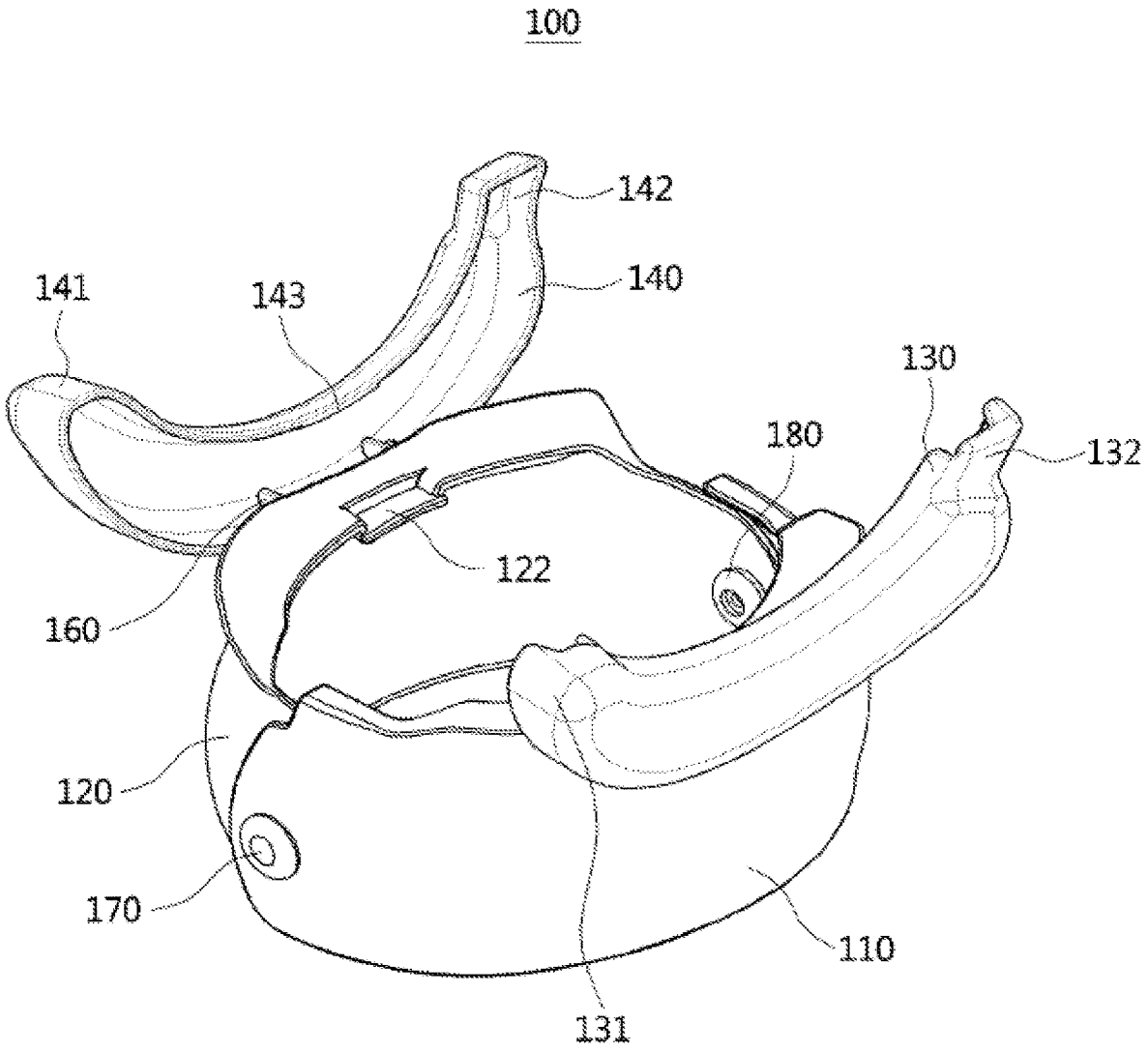
Figure 1D:
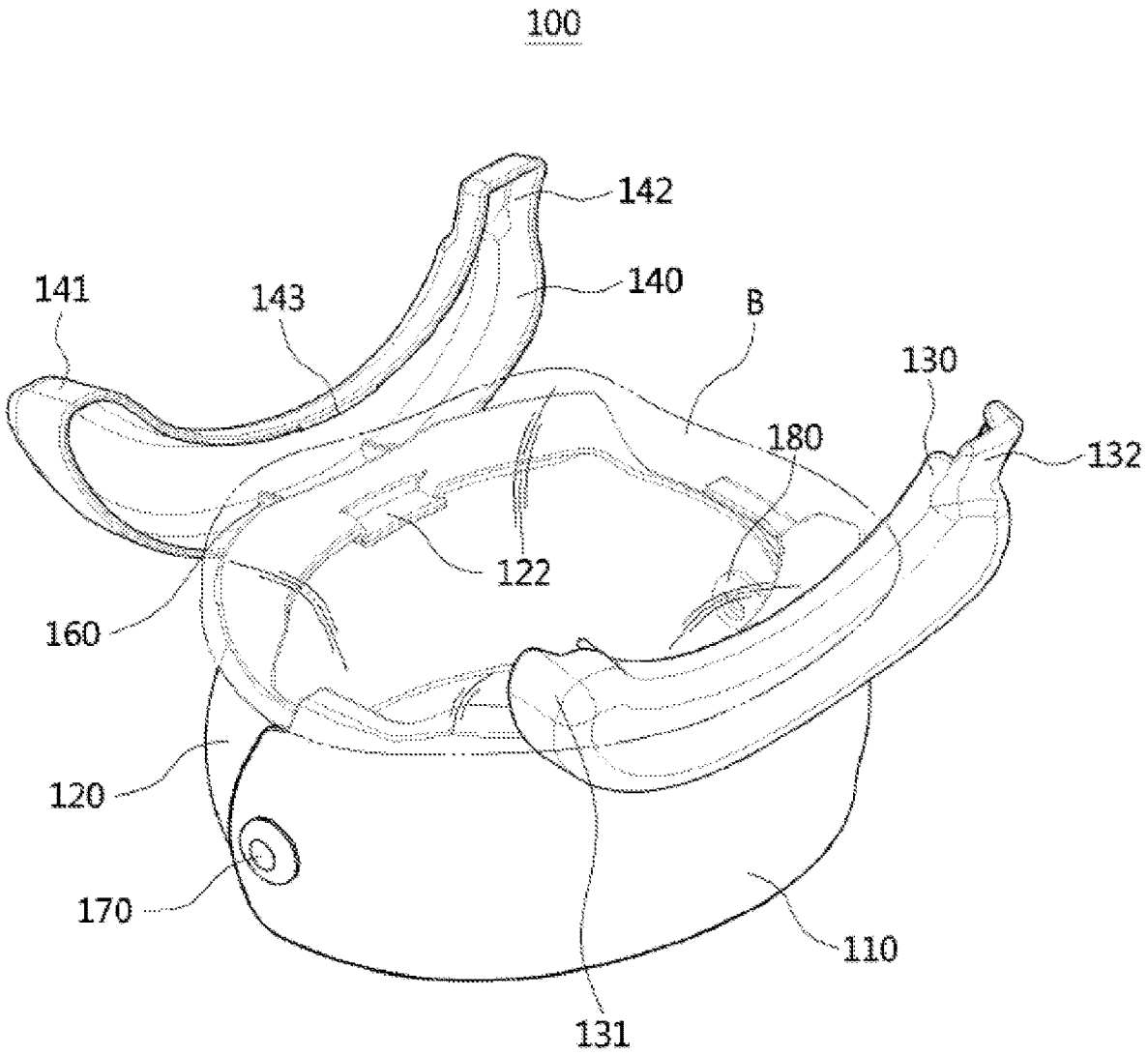

In detail, FIG. 1*a* illustrates a state in which toilet covers 130 and 140 of a portable toilet 100 are provided along the circumference of a top surface of a body 110, 120, FIGS. 1*b* and 1*c* illustrate a state in which the toilet covers 130 and 140 are rotated such that ends 131, 132, 141, and 142 of the toilet covers 130 and 140 of the portable toilet 100 face upward, and FIG. 1*d* illustrates a states in which a defecation bag B is provided to the toilet covers 130 and 140 of the portable toilet 100.

Figure 2:
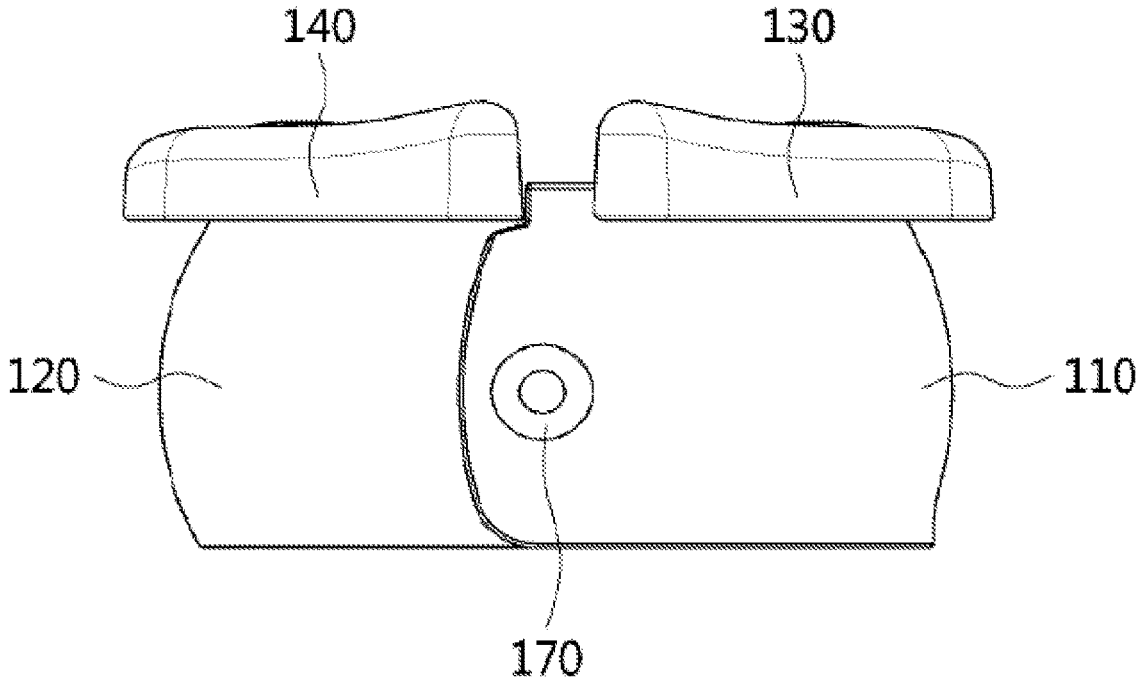
FIG. 2 is a front view of a portable toilet according to an example embodiment.
Figure 3:
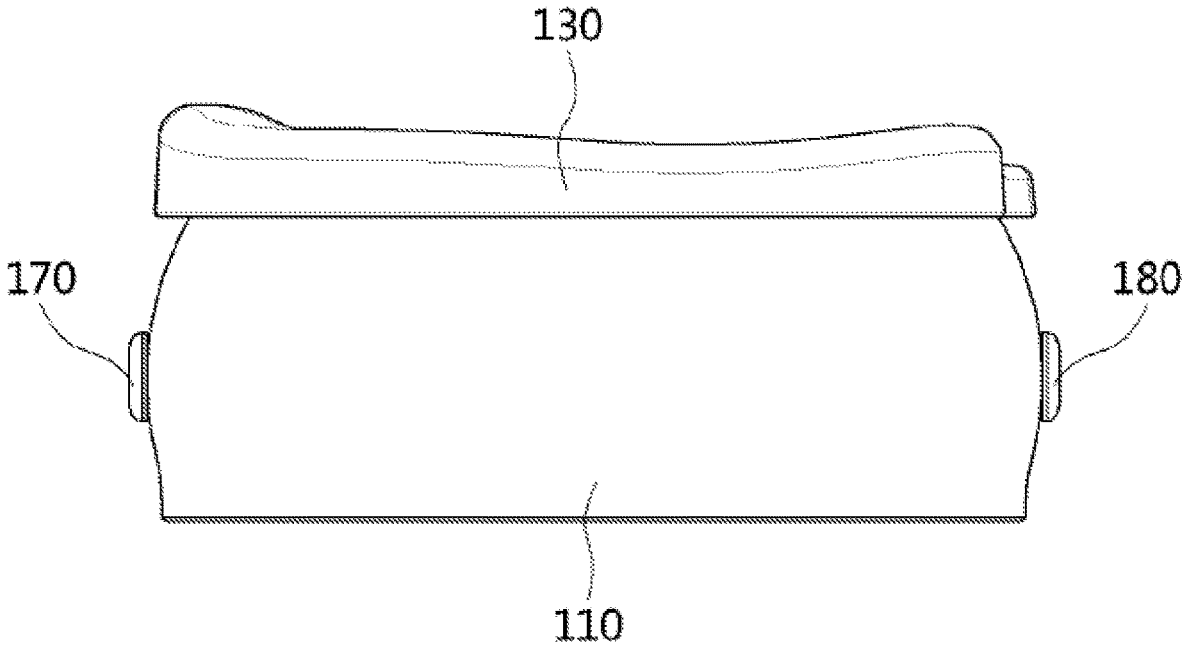
FIG. 3 is a side view of a portable toilet according to an example embodiment.
Figure 4:
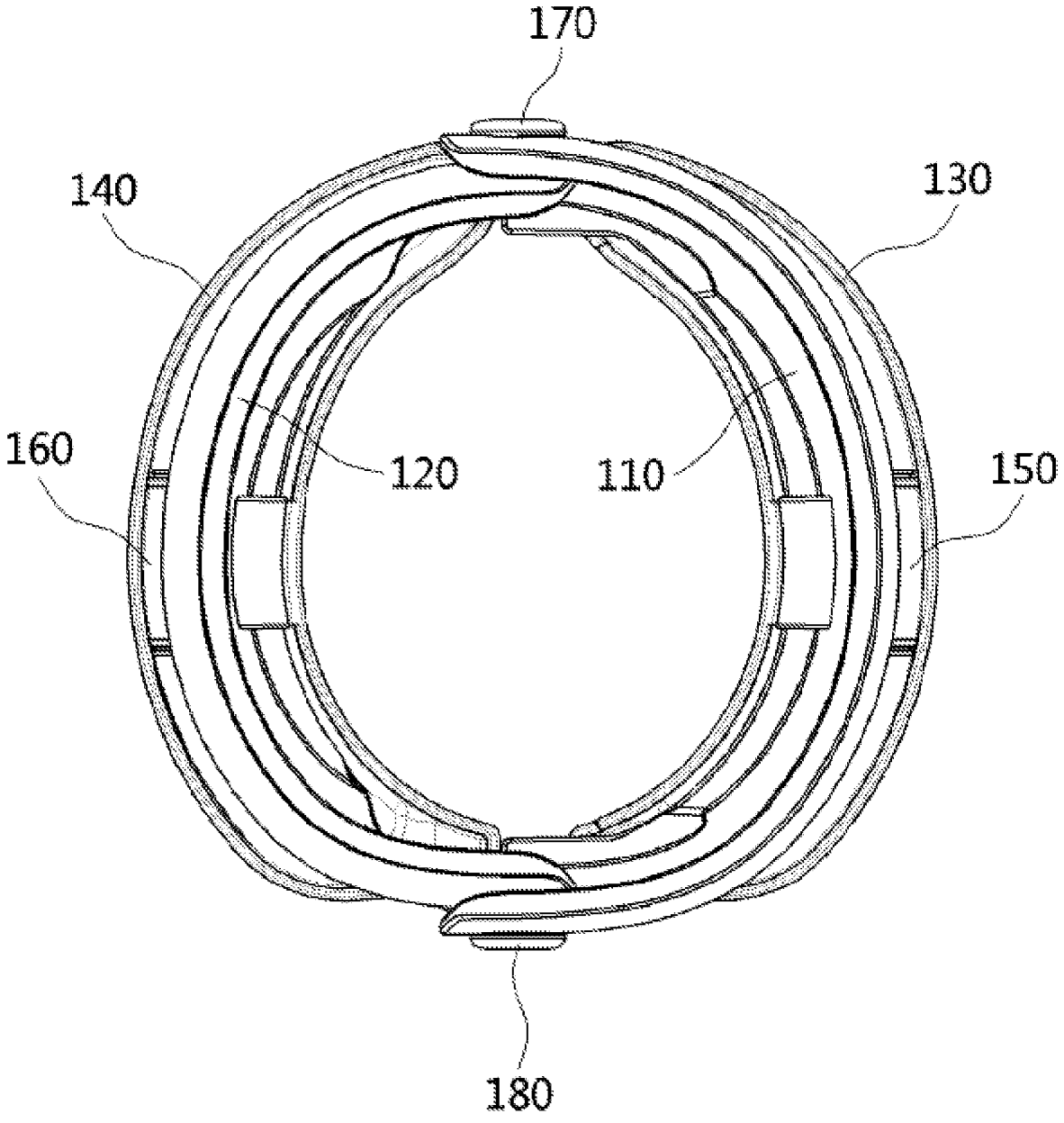
FIG. 4 is a bottom view of a portable toilet according to an example embodiment.
Figure 5:
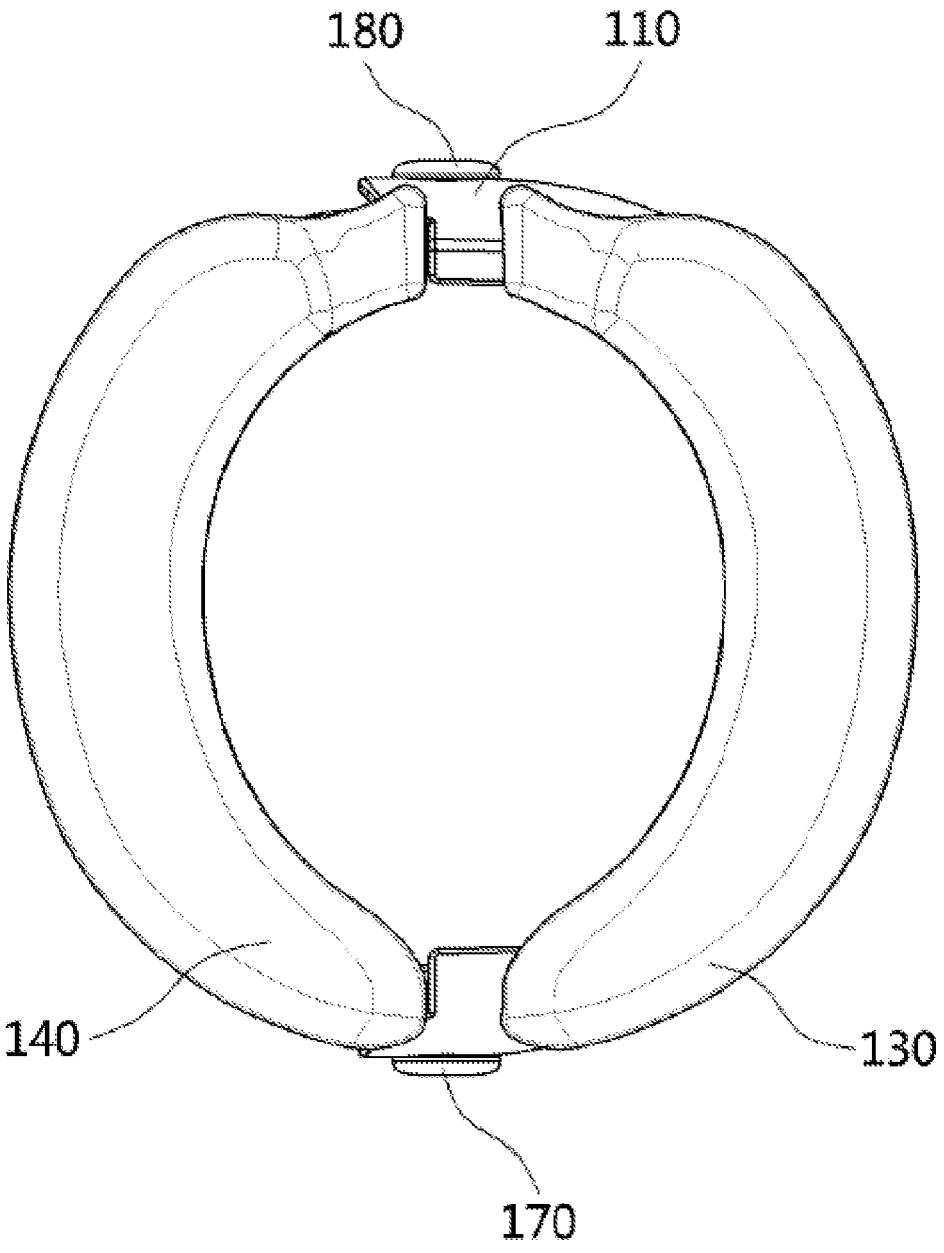
FIG. 5 is a top view of a portable toilet according to an example embodiment.

FIG. 2 is a front view of the portable toilet 100 according to an example embodiment, FIG. 3 is a side view of portable toilet 100 according to an example embodiment, FIG. 4 is a bottom view of portable toilet 100 according to an example embodiment, and FIG. 5 is a top view of portable toilet 100 according to an example embodiment.

Referring to FIG. 1*a* to FIG. 5, the portable toilet 100 may include the body 110, 120, the first toilet cover 130, the second toilet cover 140, a first hinge member 150, a second hinge member 160, a front rotational member 170, and a rear rotational member 180.

The body 110, 120 may be in a shape of a container of which a top surface and a bottom surface are open and of which an inside is empty. A portion corresponding to the open bottom surface of the body 110, 120 corresponds to a portion that is placed on the ground and a lower edge of the body 110, 120 may be packed using a material, for example, rubber, to prevent a movement of the body 110, 120.

Referring to FIG. 1*b*, the open top surface of the body 110, 120 is curved and thus, may prevent damage to the skin of a user when the skin of the user is in contact with the body 110, 120. Also, a groove or a protruding element may be formed on a curved surface.

Although it is described in detailed description and illustrated in the drawings that four grooves 114 and 124 are formed on the curved surface of the body 110, 120 and a total of four protruding elements 134 and 144 are formed on the bottom of the first toilet cover 130 and the second toilet cover 140, it is provided as an example only. The grooves 114 and 124 and the protruding elements 134 and 144 are further described below.

The body 110, 120 may include a first body member 110 and a second body member 120. Each of the first body member 110 and the second body member 120 may be formed in an arch shape.

Referring to FIG. 4, a diameter of the arch shape of the second body member 120 is formed to be less than that of the first body member 110 such that the first body member 110 and the second body member 120 may overlappingly couple with each other. That is, an end of the arch shape of the first body member 110 may be provided to cover an end of the arch shape of the second body member 120.

The first body member 110 and the second body member 120 of which the respective ends of the arch shapes are provided to overlap may couple with each other through the front rotational member 170 and the rear rotational member 180 and may configure the body 110, 120 in the shape of the container of which the inside is empty. The first body member 110 and the second body member 120 may rotate with respect to each other by using the front rotational member 170 and the rear rotational member 180 as a rotational shaft. It is further described with reference to FIGS. 6 and 7.

A transverse section of the body 110, 120 may be in a circular shape and may be in a polygonal shape. That is, the transverse section of each of the first body member 110 and the second body member 120 may be in a shape of a curve or a bent line.

The first toilet cover 130 may be formed in the arch shape and may be provided along an edge portion of the open top surface of the body 110, 120. Also, the second toilet cover 140 may be formed in the arch shape and may be provided along the edge portion of the open top surface of the body 110, 120. That is, referring to FIGS. 1*a* to 2*c*, the first toilet cover 130 may be provided at an upper end of the first body member 110 and the second toilet cover 140 may be provided at an upper end of the second body member 120.

The first toilet cover 130 and the second toilet cover 140 may be formed in a symmetrical shape, and may be provided symmetrically along a top surface edge of the body 110, 120 and thereby be formed in a cut donut shape.

Referring to FIGS. 1*a* to 1*d*, the first toilet cover 130 may be connected to the first body member 140 through the first hinge member 150, and the second toilet cover 140 may be connected to the second body member 140 through the second hinge member 160.

In detail, the first hinge member 150 may hinge-connect a bottom surface or a side surface of the first toilet cover 130 to a top curved surface of the first body member 110, such that the first toilet cover 130 may rotate with respect to the first body member 110.

For example, since the first hinge member 150 connects a center of the bottom surface of the first toilet cover 130 to the top curved surface of the first body member 110, the first toilet cover 130 may rotate (turn) with respect to the first body member 110 through the first hinge member 150. That is, a first front end 131 and a second rear end 132 that are both ends (C-shaped end portions) of the first toilet cover arch shape may move in an upward direction of the portable toilet 100 in a state contact with a top surface edge of the first body member 110.

Also, the second hinge member 160 may hinge-connect a bottom surface or a side surface of the second toilet cover 140 to a top curved surface of the second body member 120, such that the second toilet cover 140 may rotate with respect to the second body member 120.

For example, since the second hinge member 160 connects a center of the bottom surface of the second toilet cover 140 to the top curved surface of the second body member 120, the second toilet cover 140 may rotate with respect to the second body member 120 through the second hinge member 160. That is, similar to the first toilet cover 130, a second front end 141 and a second front end 142 that are both ends of the arch shape of the second toilet cover 140 may move in the upward direction of the portable toilet 100 in a state contact with a top surface edge of the second body member 110.

Accordingly, the first front end 131 of the first toilet cover 130 and the second front end 142 of the second toilet cover 140 may be provided to face each other on the first body member 110 and the second body member 120. Also, the second front end 132 and the second front end 142 may be provided to face each other. The first front end 131 and the second front end 141, and the first rear end 132 and the second rear end 142 may simultaneously move in the upward direction of the portable toilet 100 through the first hinge member 160 and the second hinge member 170.

Although it is illustrated that rotational shafts of the first hinge member 150 and the second hinge member 160 are provided to be parallel to the surfaces of the first toilet cover 130 and the second toilet cover 140 and the curved surfaces of the first body member 110 and the second body member 120 so as to move all of the first front end 131 and the first rear end 132 of the first toilet cover 130 and the second front end 141 and the second rear end 142 of the second toilet cover 140 in the upward direction of the portable toilet 100, it is provided as an example only.

For example, the first hinge member 150 may be provided to be perpendicular to the surface of the first toilet cover 130 and the first body member 110. Likewise, the second hinge member 160 may be provided to be perpendicular to the surface of the second toilet cover 140 and the second body member 120.

The first hinge member 150 that is provided to be perpendicular to the surface of the first toilet cover 130 and the first body member 110 may be provided at one side end of the first toilet cover 130. The second hinge member 160 that is provided to be perpendicular to the surface of the second toilet cover 140 and the second body member 120 may be provided at one side end of the second toilet cover 140. That is, the first hinge member 150 may turn the first toilet cover 130 in a horizontal direction with respect to the first body member 110, and the second hinge member 160 may also turn the second toilet cover 140 in a horizontal direction with respect to the second body member 120.

Referring to FIG. 1*d*, in a state in which the curved surfaces of the first body member 110 and the second body member 120 are exposed, a defecation bag B may be installed on the top curved surface of the first body member 110 or the second body member 120 exposed through rotation.

That is, the defecation bag B may be unfolded to cover the top surface edges of the first body member 110 and the second body member 120 and to be positioned inside the body 110, 120. The first toilet cover 130 or the second toilet cover 140 may rotate again to cover the top curved surfaces of the first body member 110 and the second body member 120. The defecation bag B may be fastened to the portable toilet 100 in response to a contact between the first toilet cover 130 and the first body member 110 and a contact between the second toilet cover 140 and the second body member 120.

The first toilet cover 130 and the second toilet cover 140 may rotate again and accordingly, when at least one of the ends 131, 132, 141, and 142 of the first toilet cover 130 and the second toilet cover 140 is spaced apart from the first body member 110 or the second body member 120, the installed defecation bag B may be removed.

Referring to FIGS. 1*c* and 1*d*, a locking element 122 and a hook element 143 may be provided to interlock each of between the first toilet cover 130 and the first body member 110 and between the second toilet cover 140 and the second body member 120. The locking element 122 and the hook element 143 may interlock to fasten the first toilet cover 130 or the second toilet cover 140 on the first body member 110 and the second body member 120 so as to prevent the first toilet cover 130 or the second toilet cover 140 from rotating with respect to the first body member 110 and the second body member 120.

For example, the hook element 143 may be formed on one side of the second toilet cover 140, and the locking element 122 may be formed at a location corresponding to the hook element 143 of the second toilet cover 140 when the second toilet cover 140 is in contact with the second body member 120. The hook element 143 of the second toilet cover 140 and the locking element 122 of the second body member 120 may interlock to maintain a state in which the second toilet cover 140 is in contact with second body member 120, and the hook element 143 of the second toilet cover 140 and the locking element 122 of the second body member 120 may be unlocked and allow the second toilet cover 140 to rotate with respect to the second body element 120 such that one end of the second toilet cover 140 may be spaced apart from the second body member 120.

Referring to FIG. 1*b*, the groove 114, 124 or the protruding element 134, 144 may be formed to interlock between the first toilet cover 130 and the first body member 110 and between the second toilet cover 140 and the second body member 120.

For example, the protruding elements 134 may be formed on the bottom surface of the first toilet cover 130, and the grooves 114 may be formed at positions on the top curved surface of the first body member 110 corresponding to positions of the protruding elements 134 of the first toilet cover 130. The protruding elements 144 may be formed on the bottom surface of the second toilet cover 140 and the grooves 124 may be formed at positions on the top curved surface of the second body member 120 corresponding to the protruding elements 144 of the second toilet cover 140.

The respective protruding elements 134, 144 and corresponding grooves 114, 124 may interlock or unlock in response to rotation of the first toilet cover 130 or the second toilet cover 140 with respect to the first body member 110 or the second body member 120.

The defecation bag B may firmly fasten to the portable toilet 100 through interlocking between the respective protruding elements 134, 144 and corresponding grooves 114, 124.

The top surfaces of the first toilet cover 130 and the second toilet cover 140 may be processed to be curved to protect the skin of a user. For example, each of the first toilet cover 130 and the second toilet cover 140 may be in a shape of a banana. Desirably, one end of the first toilet cover 130 or the second toilet cover 140 may protrude upward in a curved shape to correspond to a curved hip of the user for the user to stably be seated.

The first toilet cover 130 and the second toilet cover 140 may be provided to be separate from each other, and a knob may be formed on each of the bottom surface of the first toilet cover 130 and the bottom surface of the second toilet cover 140 to protect a hand when the user rotates the first toilet cover 130 and the second toilet cover 140.

Figure 6:
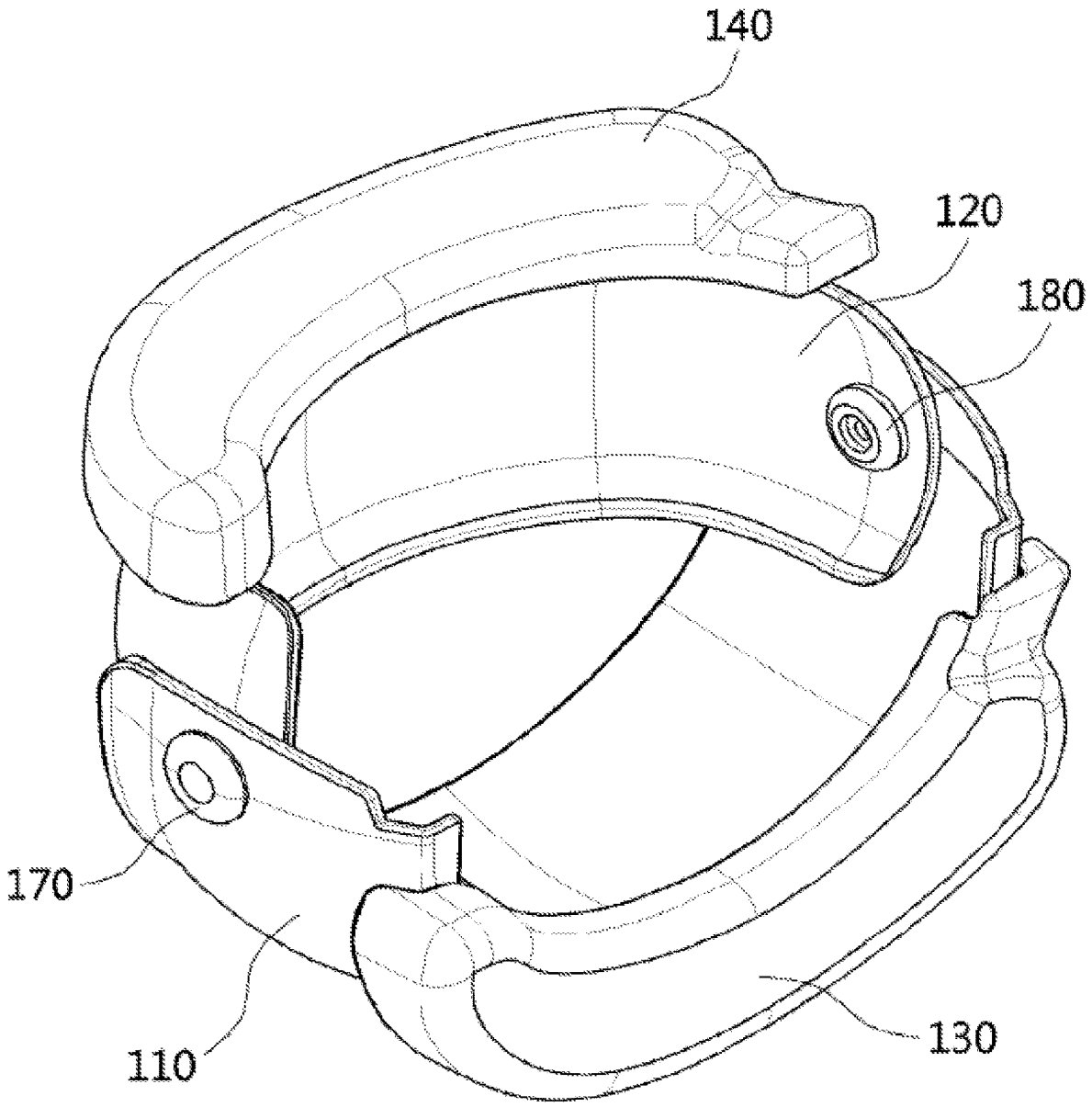
FIG. 6 illustrates a rotation of a portable toilet according to an example embodiment.
Figure 7:
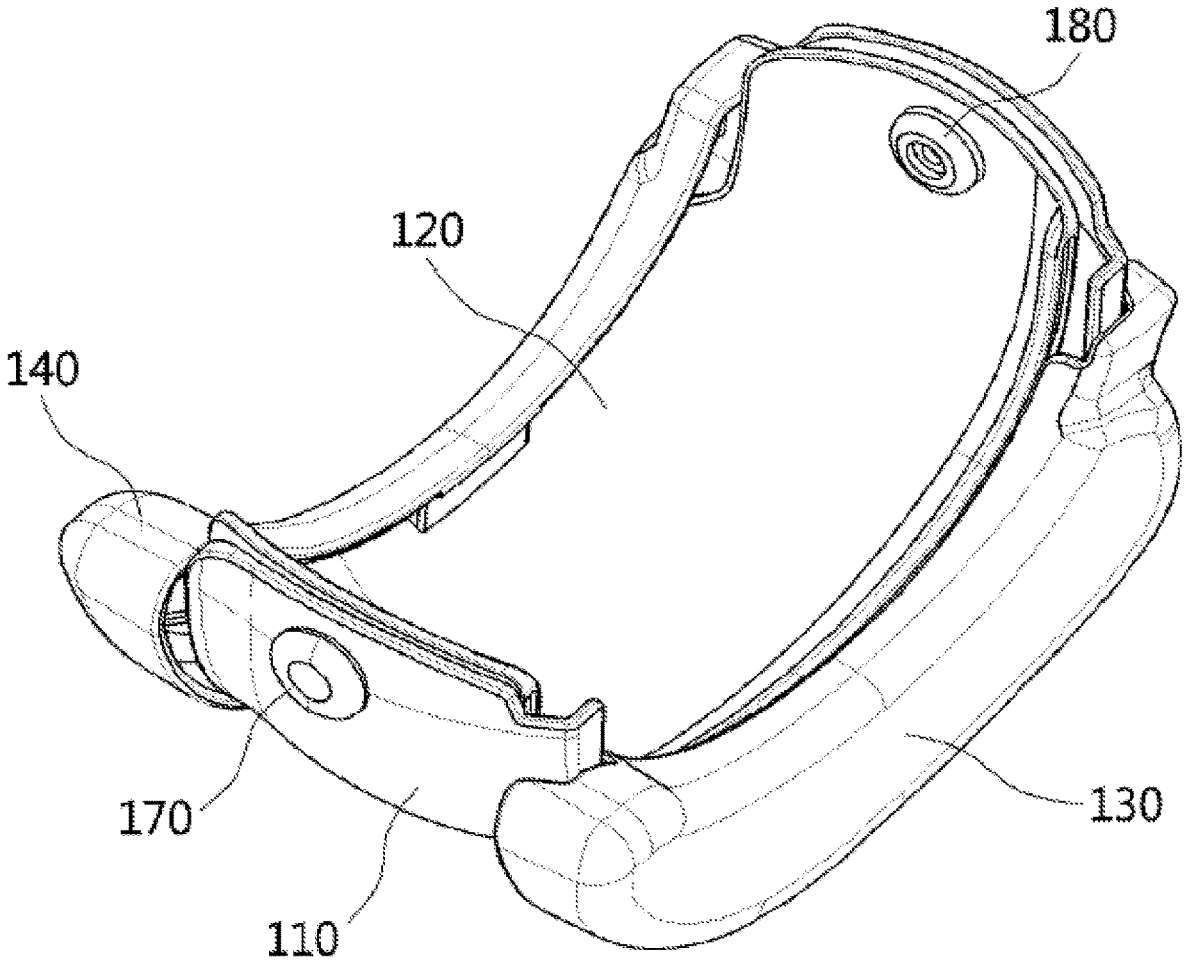
FIG. 7 illustrates a state in which a portable toilet is folded according to an example embodiment.

FIG. 6 illustrates a rotation of the portable toilet 100 according to an example embodiment, and FIG. 7 illustrates a state in which the portable toilet 100 is folded according to an example embodiment.

Referring to FIGS. 6 and 7, the front rotational member 170 and the rear rotational member 180 respectively provided at ends at which the first body member 110 and the second body member 120 overlap may be disposed to form the same rotational shaft. That is, the first body member 110 and the second body member 120 may rotate such that an outer surface of the arch shape of the second body member 120 may be positioned around an inner surface of the arch shape of the first body member 110 by using the front rotational member 170 and the rear rotational member 180 as the rotational shaft.

In response to rotation of the first body member 110 and the second body member 120, the first toilet cover 130 may be positioned along the bottom surface edge of the second body member 120 and the top surface edge of the first body member 110 that are provided to be adjacent to each other, and the second toilet cover 140 may be positioned along the bottom surface edge of the first body member 110 and the top surface edge of the second body member 120 that are provided to be adjacent to each other.

Rotation of the first body member 110 and the second body member 120 may be stopped when the first body member 110 is in contact with the second toilet cover 140 or when the second body member 120 is in contact with the first toilet cover 130.

In detail, when the bottom surface of the second toilet cover 140 positioned on the second body member 120 is in contact with the bottom surface edge of the first body member 110 in response to rotation of the first body member 110 and the second body member 120 (see FIG. 7), rotation of the first body member 110 may be stopped by the second toilet cover 140. When the bottom surface of the first toilet cover 130 positioned on the first body member 110 is in contact with the bottom surface edge of the second body member 120, rotation of the second body member 120 may be stopped by the second toilet cover 130.

Accordingly, the first body member 110 and the second body member 120 may be folded to overlap in a single arch shape.

According to the aforementioned characteristics, a bag may be fastened to a portable toilet according to an example embodiment to help child perform clean defecation, and the portable toilet may be easily installed to facilitate timely defecation when the child is performing an outdoor activity and may be reduced in volume through performing a simple rotation, for ease of moving.

Also, a portable toilet according to an example embodiment may have a toilet cover formed in a curved shape such that a child may perform defecation from a stable posture and may be in contact with the ground to stably support a weight of the child.

Also, a defecation bag may be firmly fastened or easily remove from a portable toilet according to an example embodiment, and the portable toilet may be deformed in an arch shape to efficiently use an inside space of a handbag when the portable toilet is kept in the handbag of a parent.

Although a number of example embodiments, such as detailed constituent elements, have been described above, it is provided to help the general understanding of the disclosure and the disclosure is not limited to the example embodiments. Further, it should be understood to those skilled in the art that various changes and modifications could be made from the description. Therefore, the scope of the disclosure is defined not by the detailed description, but by the claims and their equivalents, and all variations within the scope of the claims and their equivalents are to be construed as being included in the disclosure.

What is claimed is:

1. A portable toilet comprising:

a body in a shape of a container of which a top surface is open and an inside is empty;

a first toilet cover provided on the open top surface and formed in an arch shape; and a second toilet cover provided on the open top surface to be symmetrical to the first toilet cover, wherein each of the first toilet cover and the second toilet cover rotates with respect to the body such that each one end of the first toilet cover and the second toilet cover is spaced apart with respect to the body, wherein ends of the first toilet cover and ends of the second toilet cover are hinge-connected to the body at two sides of the top surface of the body to rotate in an upward direction or a horizontal direction in a state in which the ends of the first toilet cover and the ends of the second toilet cover are provided to face each other.

2. The portable toilet of claim 1, wherein, when ends of the first toilet cover and the second toilet cover rotate in an upward direction, a defecation bag is installed along the circumference of the open top surface of the body and inside the body.

3. The portable toilet of claim 1, wherein the body comprises a first body member and a second body member, the first body member is formed in the arch shape and the second body member is formed in the arch shape such that the body is in the shape of the container of which the inside is empty, a diameter of the arch shape of the second body member is formed to be less than that of the first body member, the first body member and the second body member are provided such that the respective ends of the arch shapes overlap, the end of the first body member and the end of the second body member are formed to be rotatable with respect to each other, and the first body member and the second body member rotate such that the second body member folds within the arch shape of the first body member to be overlappingly folded in a single arch shape.

4. The portable toilet of claim 3, wherein the first toilet cover is hinge-connected to the first body member and the second toilet cover is hinge-connected to the second body member, such that the first toilet cover and the second toilet cover are respectively provided on both sides of the folded arch shape that is formed in response to rotation of the first body member and the second body member.

5. The portable toilet of claim 4, wherein the rotation of the first body member and the second body member is suspended in response to a contact between a lower edge of the first body member and a bottom surface of the second toilet cover or a contact between a lower edge of the second body member and the bottom surface of the second toilet cover.

6. The portable toilet of claim 1, wherein the body comprises one of a locking element and a hook element, the first toilet cover and the second toilet cover comprise another one of a locking element and a hook element corresponding to the locking element or the hook element of the body, and the respective corresponding locking element and hook element couple with each other such that the first toilet cover and the second toilet cover fasten to the body.

* * * * *